US007188380B1

(12) United States Patent
Wang

(10) Patent No.: US 7,188,380 B1
(45) Date of Patent: Mar. 13, 2007

(54) FABRICATED BEDSTEAD MEMBER

(76) Inventor: Hao-Jen Wang, P.O. Box 44-2049, Taipei (TW) 10668

( * ) Notice: Subject to any disclaimer, the term of this patent is extended or adjusted under 35 U.S.C. 154(b) by 0 days.

(21) Appl. No.: 11/389,190

(22) Filed: Mar. 27, 2006

(51) Int. Cl.
*A47C 19/00* (2006.01)
*A47C 23/00* (2006.01)

(52) U.S. Cl. ..... 5/279.1

(58) Field of Classification Search ..... 5/425, 5/430, 424, 428; 52/663; 256/47, 32; 404/6; 403/286, 293; 24/DIG. 41, DIG. 42; 211/181.1, 211/106, 186, 85.31, 133.5, 189
See application file for complete search history.

(56) References Cited

U.S. PATENT DOCUMENTS 1,477,349 A * 12/1923 Hindmarsh et al. ..... 256/47
2,475,906 A * 7/1949 Lutey ..... 160/229.1
2,972,153 A * 2/1961 Turk ..... 5/429
3,233,893 A * 2/1966 Meyer ..... 472/90
3,546,844 A * 12/1970 Schwartz ..... 52/581
3,608,105 A * 9/1971 Flatford ..... 5/232
3,842,456 A * 10/1974 Bronstien, Jr. ..... 5/404
3,972,110 A * 8/1976 Sasena ..... 29/452
4,086,671 A * 5/1978 Lane ..... 5/18.1
4,259,756 A * 4/1981 Pace ..... 5/81.1 HS
4,439,880 A * 4/1984 Koncelik et al. ..... 5/429
4,867,421 A * 9/1989 Vernon ..... 256/54
4,903,354 A * 2/1990 Yeh ..... 5/53.1
5,110,094 A * 5/1992 Kruse ..... 256/47
5,426,796 A * 6/1995 Stanton ..... 5/13
5,718,094 A * 2/1998 Meurer ..... 52/656.8
5,794,990 A * 8/1998 Coppedge ..... 292/153
5,921,530 A * 7/1999 Joyce et al. ..... 256/48
6,415,564 B1 * 7/2002 Beer ..... 52/204.61
6,898,914 B2 * 5/2005 Folsom et al. ..... 52/656.8
6,983,496 B1 * 1/2006 Hernandez ..... 5/93.1

* cited by examiner

*Primary Examiner*—Patricia Engle
*Assistant Examiner*—Jonathan Liu
(74) *Attorney, Agent, or Firm*—Charles E. Baxley

(57) ABSTRACT

This invention relates to a fabricated bedstead, in particular a fabricated bedstead that is applicable to a metal sofa bed or a bunk bed. The invention mainly comprises a bedstead that is made of different lengths of cannular shafts. The invention enables respective round hook portions on one ends of pluralities of thin vertical lines and thin horizontal lines to pierce through those cannular shafts, and those round hook portions are correspondingly positioned in waterdrop-shaped trough portions of said cannular shafts. The fabricated member of the invention effectively reduces the volume of material and manufacturing cost.

1 Claim, 8 Drawing Sheets

FABRICATED BEDSTEAD MEMBER

BACKGROUND OF THE INVENTION (1) Field of the Invention

This invention relates to a bedstead member, in particular, a fabricated bedstead that is applicable to a metal sofa bed or a bunk bed, enabling to effectively reduce the volume of material and manufacturing cost.

(2) Description of the Prior Art

Generally, a wide selection of metal furniture, including sofa bed, bunk bed, etc., is popular in the market, for the reasons of its light and handy quality and recyclable characteristic.

A conventional sofa bed or a bunk bed is made by welding its bedstead for assembly. FIG. 1 is a perspective view showing the appearance of a conventional sofa bed (1), wherein the bedstead is made of a large scale of external bedframe (10) with pluralities of side tubes (11) to be welded and positioned one by one in the bedframe; FIG. 2 shows the appearance of another conventional sofa bed (2), wherein the bedstead is also made of a large scale of external bedframe (20) with pluralities of thin shafts (21) to be welded and positioned one by one in the bedframe. Nevertheless, both charts of FIGS. 1 and 2 have the following drawbacks:

(A) The bedframe welding and assembly method causes great inconvenience during packing, transit or in a storehouse due to the enormous volume of material, so as to increase the costs;

(B) All components are made by welding, resulting in inefficacious productivity and longer processing time with poor economic effect; and (C) Such welding and assembly method results in unable to flexibly provide DIY function and fun for general customers.

In view of the foregoing, a fabricated bedstead of the invention is hereafter disclosed to achieve the practicability effect in the industry.

SUMMARY OF THE INVENTION

Further aspects, objects, and desirable features of the invention will be better understood from the detailed description and drawings that follow in which various embodiments of the disclosed invention are illustrated by way of examples.

DETAILED DESCRIPTION OF THE PREFERRED EMBODIMENTS

Figure 1:
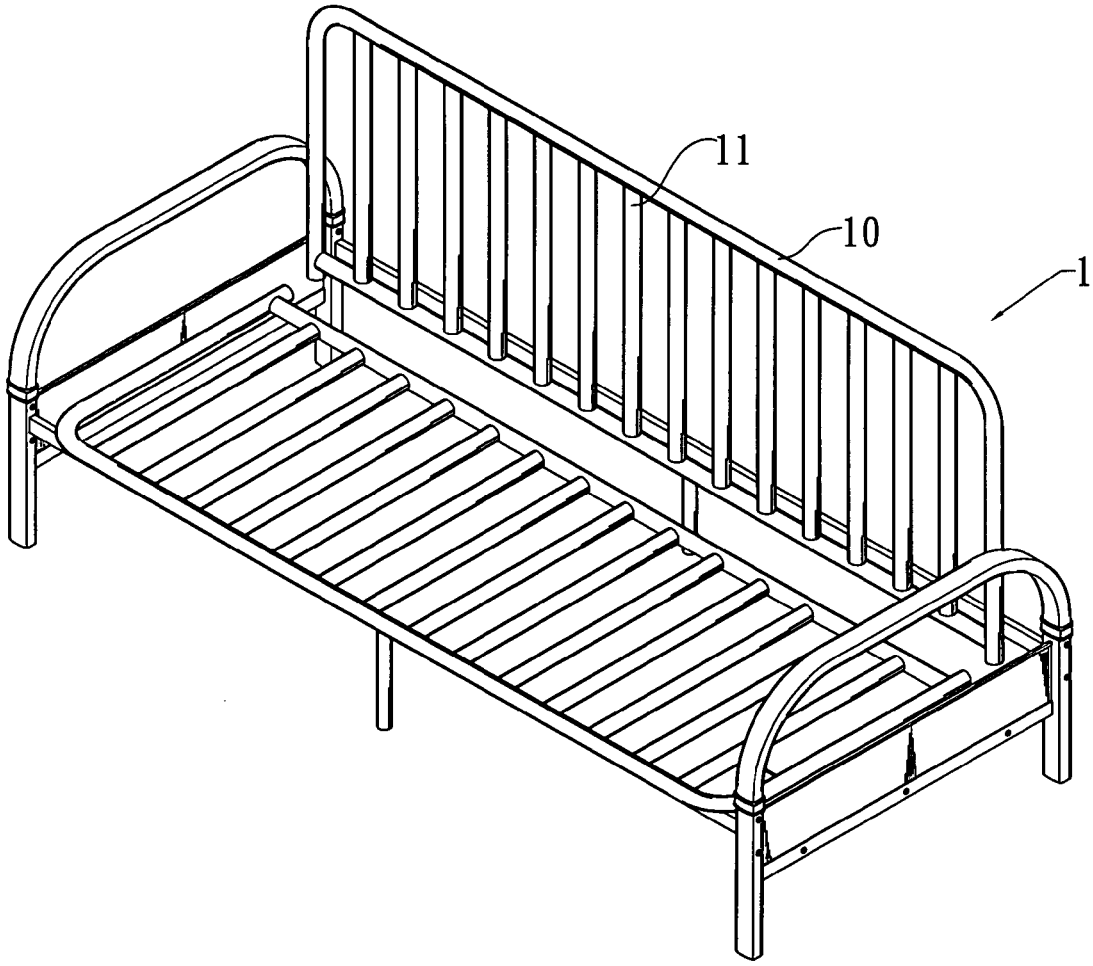
FIG. 1 PRIOR ART
FIG. 1 is a three-dimensional diagram (I) showing the appearance of a conventional metal sofa bed.
Figure 2:
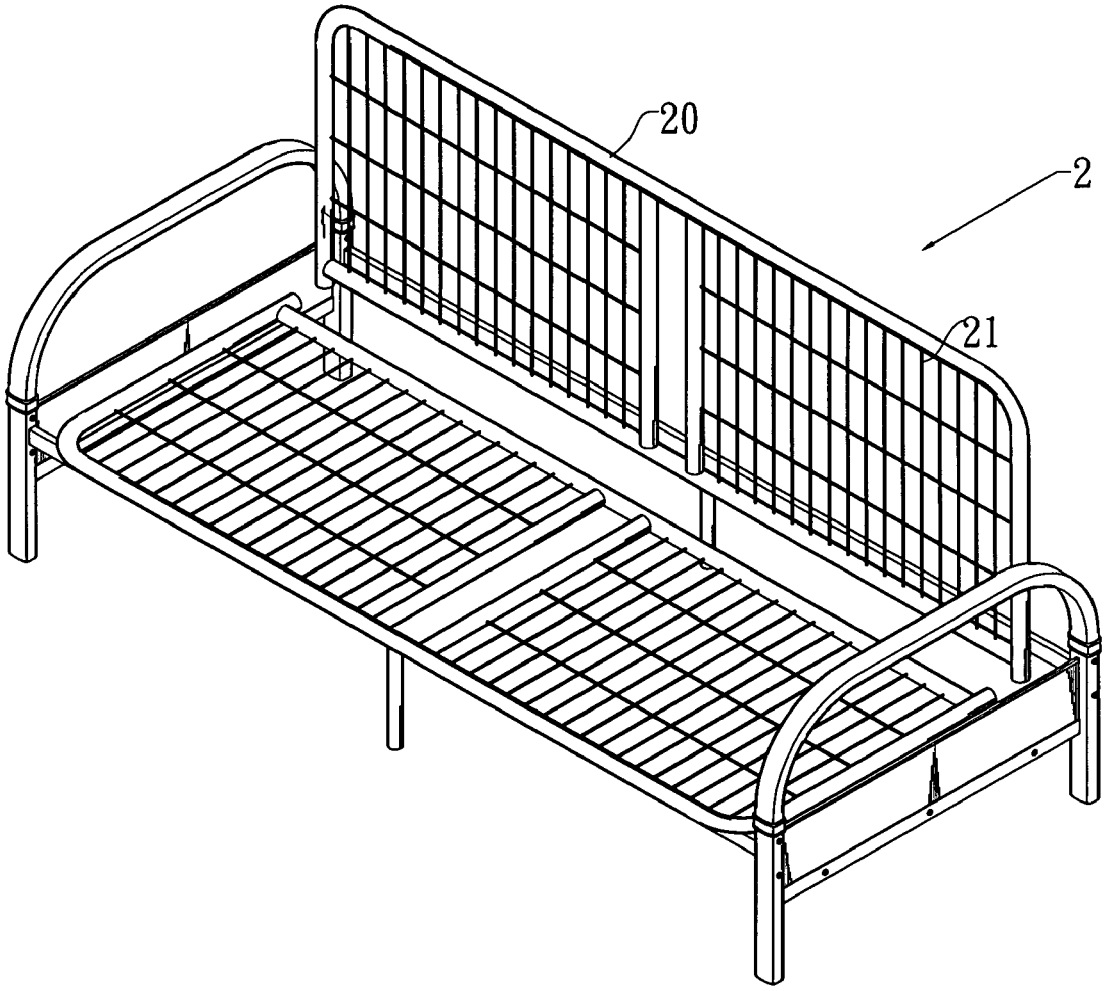
FIG. 2 PRIOR ART
FIG. 2 is a three-dimensional diagram (II) showing the appearance of a conventional metal sofa bed.
Figure 3:
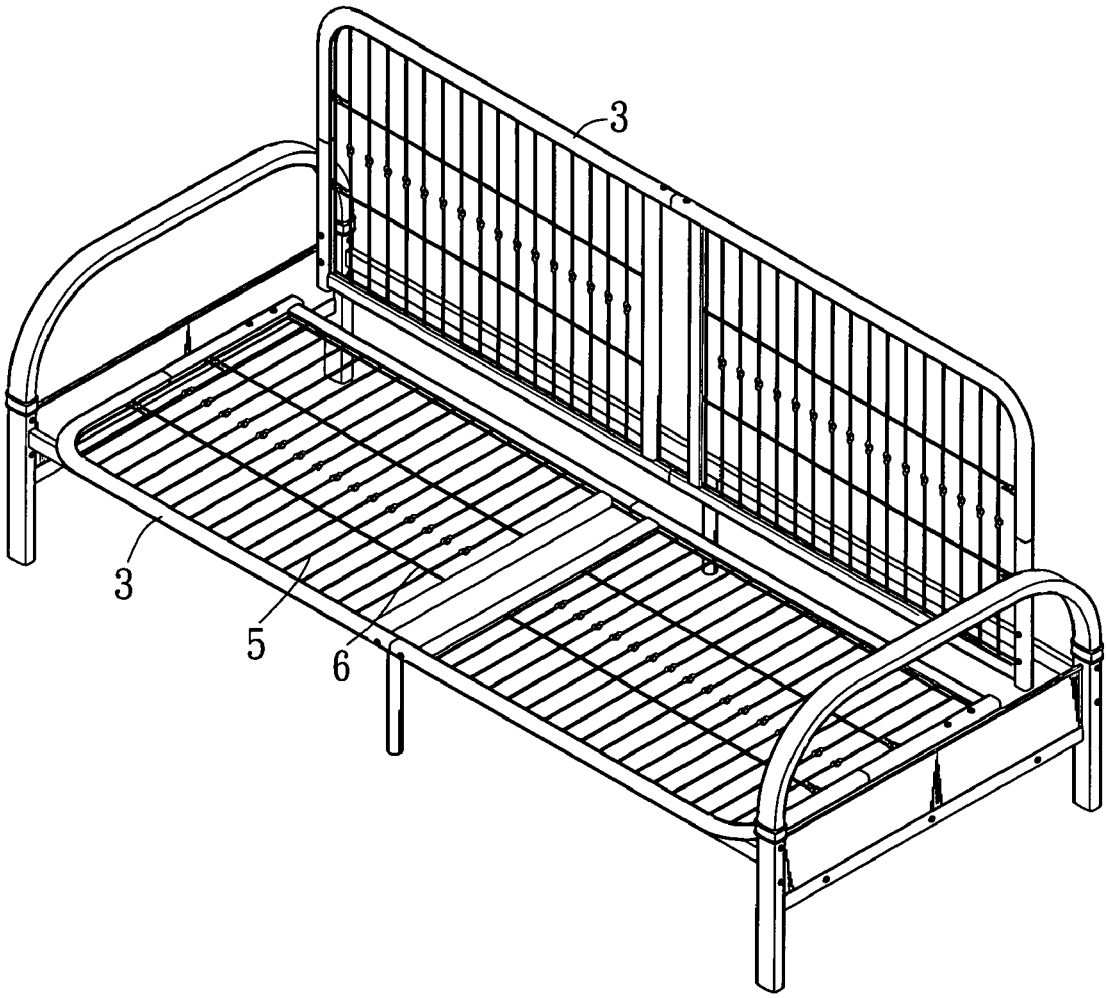
FIG. 3 is a three-dimensional view showing the appearance of a preferred embodiment of a sofa bed of the invention.
Figure 4:
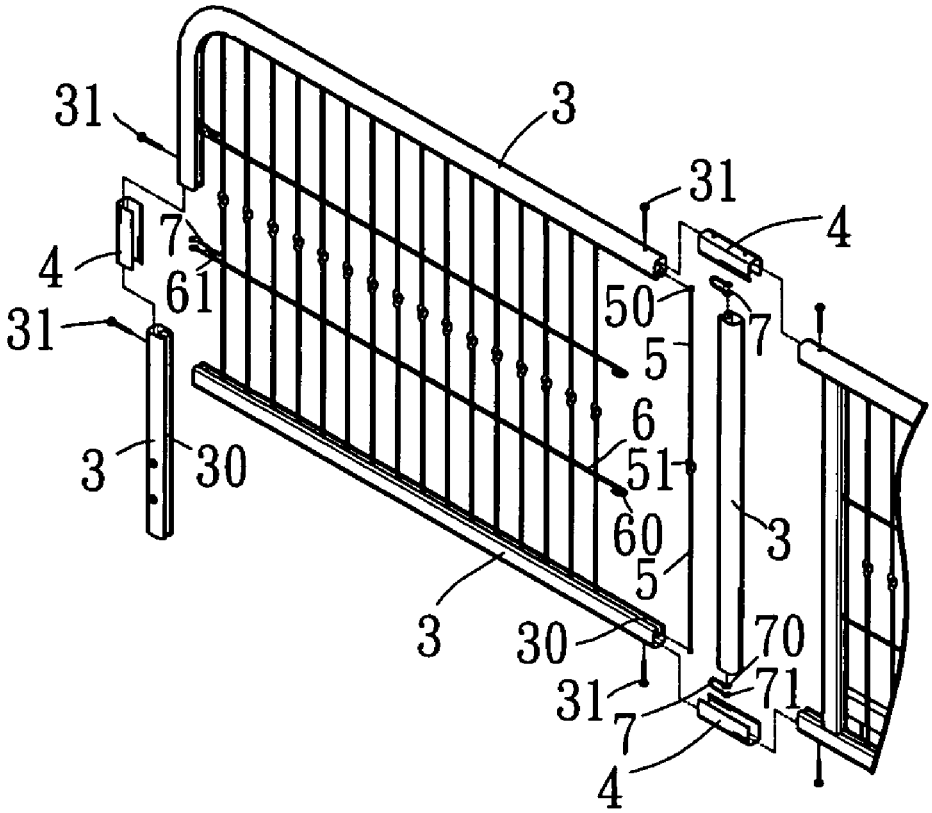
FIG. 4 is a three-dimensional view showing the decomposition of the preferred embodiment member of the invention.
Figure 7:
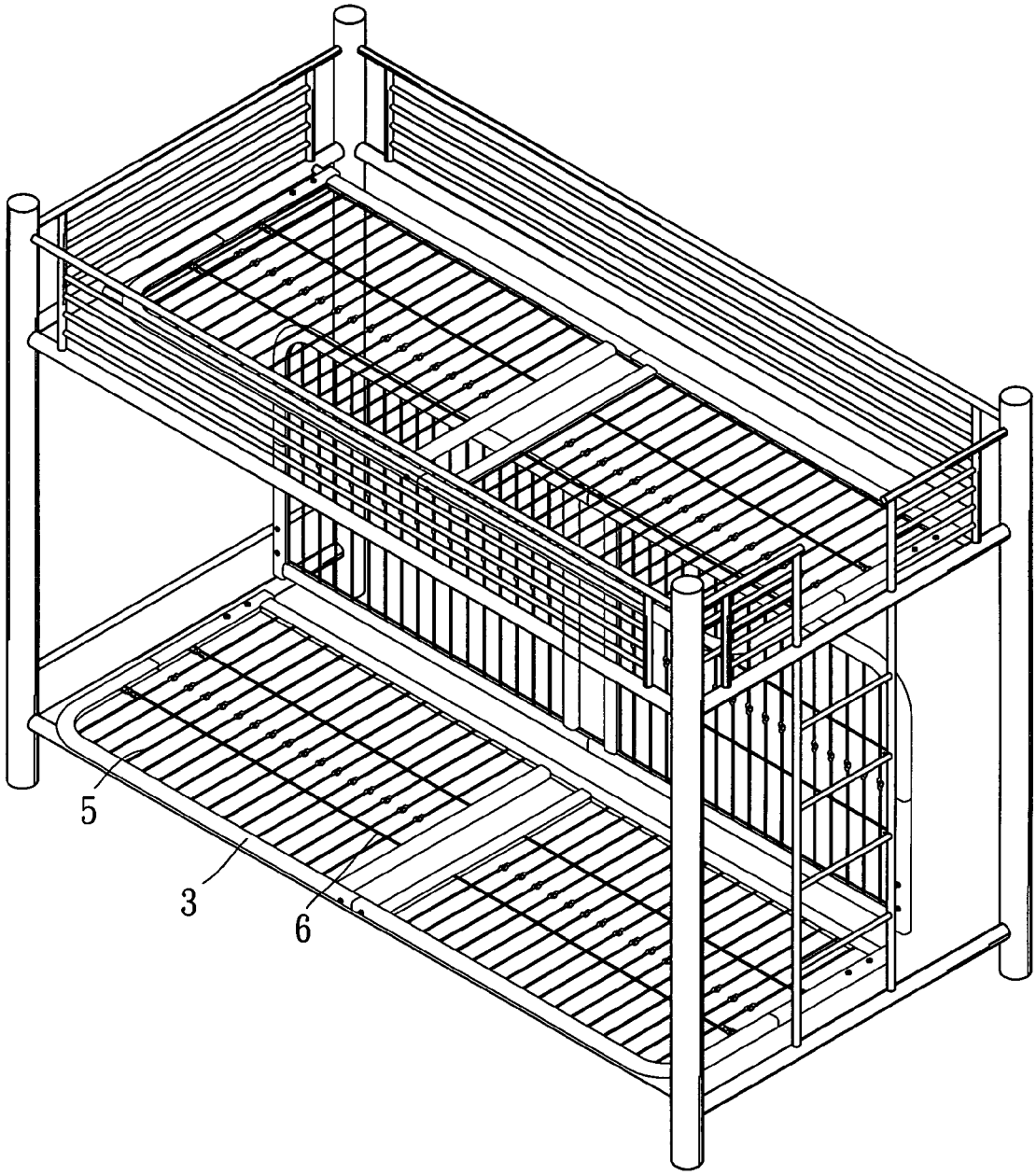
FIG. 7 is a perspective view of another preferred embodiment showing the assembly of a bunk bed of the invention.

FIG. 3 and FIG. 7 show the appearance of the invention after the assembly thereof on a metal sofa bed or a bunk bed. FIG. 4 is a perspective view showing the decomposition of said bedstead, which comprises a kind of cannular shaft material (3) that is divided into a plurality of shafts to be assembled into said bedstead; the circular shaft (3) is formed as a "U"shape, having a concave trough portion (30) disposed on the abdominal region thereof based on required tube diameter. The trough portion (30) is formed as a waterdrop-shaped structure having larger space therein and smaller on the exterior, so as to form an inner round shape space with a narrow edge on the opening area.

Figure 5:
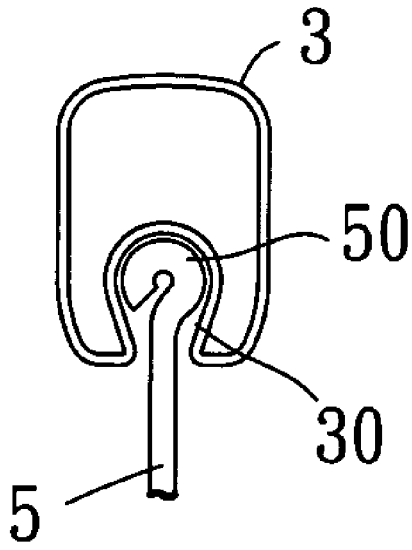
FIG. 5 is a three-dimensional view showing the integration of a thin and vertical line, a round hook portion and a waterdrop-shaped trough portion and a cannular shaft of the invention.
Figure 5A:
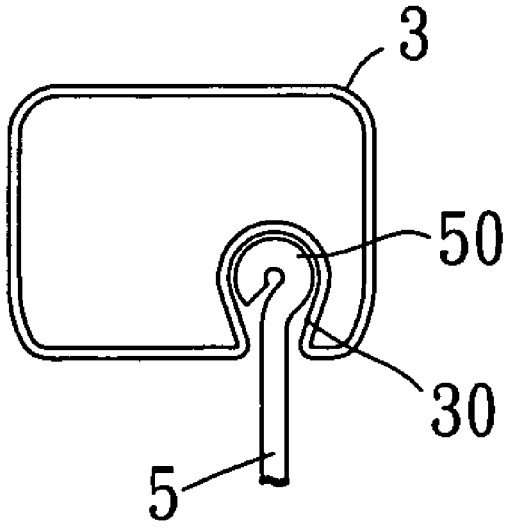
FIG. 5A is a perspective view showing various diameters of cannular shafts according to the invention.
Figure 6:
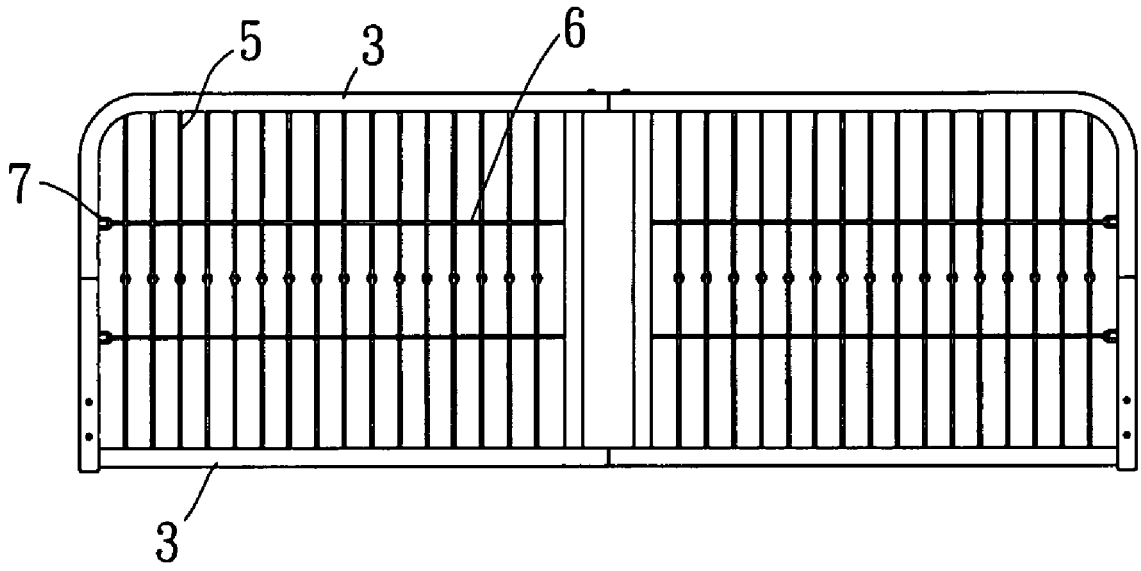
FIG. 6 is a perspective view of another preferred embodiment showing the assembly of bedstead of the invention.

Every two circular shafts (3) are joined together with a U-shaped connecting element (4), which is able to pierce into the inner space of said circular shaft (3) to be joined and screwed by bolts (31) from outside as appropriate (as shown in FIGS. 5, 5A and 6);

The bedstead frame comprises a plurality of thin and vertical shafts (5) and a plurality of thin and horizontal shafts (6) assembled inside.

The thin and vertical shafts (5) each has round hook portions (50) and (51) bent on both ends thereof, thereby a round hook portion (50) on one end thereof is hooked up with another round hook portion (50) on one end of another thin and vertical shaft (5), in the meanwhile, said round hook portion (51) on the other end thereof pierces into a correspondent trough portion (30) of said cannular shaft (3) of the bedstead. The thin and vertical shaft (5) is then positioned therein owing to the narrow edge of the trough portion (30).

Moreover, the thin and horizontal shafts (6) each has hooks (60) and (61) disposed on both ends thereof for respectively hooking a U-shaped member (7) each, the U-shaped member (7) has the both open ends thereof respectively bent into round hook portions (70) and (71) for piercing into said trough portions (30) and being positioned in the cannular shaft (3).

Therefore, the invention as described above enables more efficient processing, in the meanwhile, the invention is able to be separated into smaller volume of members for being carried during packing, transit or in a storehouse to reduce the costs accordingly, in addition, allows a user to assemble the bedstead by himself/herself.

New characteristics and advantages of the invention covered by this document have been set forth in the foregoing description. It is to be expressly understood, however, that the drawings are for the purpose of illustration only and are not intended as a definition of the limits of the invention. Changes in methods, shapes, structures or devices may be made in details without exceeding the scope of the invention by those who are skilled in the art. The scope of the invention is, of course, defined in the language in which the appended claims are expressed.

What is claimed is:

1. A bedstead comprising:

a plurality of cannular shafts each including a concave trough portion formed therein, the concave trough portions of the cannular shafts each including a waterdrop-shaped structure having a larger inner space and a smaller exterior so as to form an inner round shape space with a narrow edge on an opening area, a plurality of U-shaped connecting elements engaged into the cannular shafts and joined to the cannular shafts with bolts, a plurality of vertical shafts each including two ends, the ends of the vertical shafts each including a round hook portion, the round hook portions at one end of the vertical shafts being engaged into the concave trough portions of the cannular shafts and retained in the concave trough portions of the cannular shafts with the narrow edges of the concave trough portions of the cannular shafts, and the round hook portions at the other end of the vertical shafts being hooked with the round hook portions of the other vertical shafts, a plurality of horizontal shafts each including two ends, the ends of the horizontal shafts each including a hook, and a plurality of U-shaped members hooked to the hooks of the horizontal shafts and each including two ends, the ends of the U-shaped members each including a round hook portion, the round hook portions of the U-shaped members being engaged into the concave trough portions of the cannular shafts and retained in the concave trough portions of the cannular shafts with the narrow edges of the concave trough portions of the cannular shafts.

* * * * *